US011883726B2

(12) United States Patent
Kontir

(10) Patent No.: US 11,883,726 B2
(45) Date of Patent: Jan. 30, 2024

(54) FACE-OFF TRAINING DEVICE AND METHOD OF USE

(71) Applicant: Richard Kontir, Hellertown, PA (US)

(72) Inventor: Richard Kontir, Hellertown, PA (US)

( * ) Notice: Subject to any disclaimer, the term of this patent is extended or adjusted under 35 U.S.C. 154(b) by 103 days.

(21) Appl. No.: 17/337,826

(22) Filed: Jun. 3, 2021

(65) Prior Publication Data

US 2021/0387067 A1 Dec. 16, 2021

Related U.S. Application Data

(60) Provisional application No. 63/037,803, filed on Jun. 11, 2020.

(51) Int. Cl.

| | |
|---|---|
| ***A63B 69/00*** | (2006.01) |
| ***A63B 21/04*** | (2006.01) |
| ***A63B 59/70*** | (2015.01) |
| ***A63B 21/055*** | (2006.01) |
| ***A63B 102/14*** | (2015.01) |

(52) U.S. Cl.

CPC ..... *A63B 69/0024* (2013.01); *A63B 21/0442* (2013.01); *A63B 21/0557* (2013.01); *A63B 59/70* (2015.10); *A63B 69/0026* (2013.01); *A63B 2102/14* (2015.10)

(58) Field of Classification Search

CPC ..... A63B 69/0024; A63B 59/70

See application file for complete search history.

(56) References Cited

U.S. PATENT DOCUMENTS

| | | | | |
|---|---|---|---|---|
| 2,103,502 | A * | 12/1937 | Webster | A63B 69/3608 473/215 |
| 4,749,189 | A | 6/1988 | Frank | |
| 5,156,402 | A | 10/1992 | Hart | |
| 5,256,119 | A * | 10/1993 | Tudor | A63B 23/04 128/882 |
| 5,362,295 | A * | 11/1994 | Nurge | A63B 21/4013 482/121 |
| 5,704,856 | A * | 1/1998 | Morse | A63B 69/0002 473/212 |
| 6,129,638 | A * | 10/2000 | Davis | A63B 69/0059 473/277 |
| 6,245,002 | B1 | 6/2001 | Beliakov | |
| 6,270,430 | B1 * | 8/2001 | Nicoloff | A63B 69/0026 473/277 |
| 6,569,041 | B1 | 5/2003 | Riivald | |

(Continued)

FOREIGN PATENT DOCUMENTS

CA 1221593 5/1987

*Primary Examiner* — Eugene L Kim
*Assistant Examiner* — Christopher Glenn
(74) *Attorney, Agent, or Firm* — Caesar Rivise, PC

(57) ABSTRACT

A device and methods for training a person for face-offs in athletic activities and games. The device includes a base connector, a main resilient member, and a stick wrap. The stick wrap is connected to the heel of the stick and to the main resilient member. The base connector is connected to the main resilient member and serves to connect the training device to a stationary structure. The main resilient member is configured to provide a desired level of resistance to a face-off motion of the stick by the user. An auxiliary resilient member is provided for connection in parallel to the main resilient member to enable the device to provide increased resistance to the face-off motion of the stick by the user.

12 Claims, 5 Drawing Sheets

(56) References Cited

U.S. PATENT DOCUMENTS

| | | | | |
|---|---|---|---|---|
| 6,638,186 | B2 | 10/2003 | Williams | |
| 6,672,973 | B1 * | 1/2004 | Muntz | A63B 69/0059 473/217 |
| 6,949,035 | B1 * | 9/2005 | Halsworth | A63B 69/0026 482/121 |
| 7,121,964 | B1 | 10/2006 | Dahm et al. | |
| 7,811,185 | B1 * | 10/2010 | Reynolds | A63B 69/0059 473/207 |
| 8,512,171 | B1 * | 8/2013 | Minotti | A63B 69/0057 473/422 |
| 10,272,311 | B2 | 4/2019 | Bear | |
| 2002/0151386 | A1 | 10/2002 | Williams | |
| 2006/0183609 | A1 * | 8/2006 | Flynn | A63B 21/4015 482/124 |
| 2007/0232404 | A1 * | 10/2007 | Begert | A63B 69/0059 473/216 |
| 2008/0102971 | A1 * | 5/2008 | Anderson | A63B 69/0002 473/215 |
| 2010/0035706 | A1 | 2/2010 | Sanchez | |
| 2010/0285939 | A1 * | 11/2010 | Latronica | A63B 21/16 482/139 |
| 2010/0317495 | A1 * | 12/2010 | DiGiovanni | A63B 21/151 482/129 |
| 2011/0212797 | A1 | 9/2011 | Adkins | |
| 2011/0237359 | A1 * | 9/2011 | Purl | A63B 21/0552 473/422 |
| 2017/0113115 | A1 * | 4/2017 | Gilardo | A63B 21/4011 |
| 2017/0252621 | A1 * | 9/2017 | Ross | A63B 69/0059 |
| 2019/0060696 | A1 * | 2/2019 | Moore | A63B 21/0428 |

* cited by examiner

FACE-OFF TRAINING DEVICE AND METHOD OF USE

CROSS-REFERENCE TO RELATED APPLICATIONS

This utility application claims the benefit under 35 U.S.C. § 119(e) of Provisional Application Ser. No. 63/037,803, filed on Jun. 11, 2020, entitled "Face Off Training Tool". The entire disclosure of that provisional application is incorporated by reference herein.

FIELD OF THE INVENTION

The present invention(s) relates to training devices or tools for athletes practicing face offs, particularly with respect to face offs in ice hockey, lacrosse, roller and street hockey, etc., as well as generally to methods for practicing face offs in such sports.

BACKGROUND OF THE INVENTION

There are a variety of sports training devices, apparatus, methods, and exercise machines to assist athletes, players, and others improve their skills in various sports, games, and athletic activities. For example, there are swinging aids and methods designed to improve the swing or other moves of golfers, baseball players, hockey players and other persons in other sports.

Many of those devices, apparatus, methods, and machines use flexible or elastic cables or other types of cords to provide or enable resistance when used by users, such as during batting practice or practicing their golf swing. Some involve complex equipment using pulleys and weight systems that can only be used at one location. And some require the assistance of a second person.

The patent literature includes various devices for training persons to play hockey. For example, U.S. Pat. No. 6,949,035 (Halsworth) is directed to a sports training device that includes a tethered bat or other sports equipment, such as a hockey stick, attached by flexible elastic to a fixed anchor point, or to a pulley and weight system. In one embodiment, a swivel attachment is attached to the distal end of the training device and a yoke is attached to the swivel attachment, and an elastic cord is attached to the yoke at one end and to a fixed point at the other.

U.S. Pat. No. 4,749,189 (Frank) discloses an exercise machine for hockey players that includes a cable elastically tethered to a frame on one end and to a blade of a hockey stick on the other.

U.S. Pat. No. 6,569,041 (Riivald) is directed to an ice hockey training apparatus for developing stick control and correct shooting movements while also increasing strength, balance and accuracy.

U.S. Pat. No. 10,272,311 (Bear) is directed to a hockey face off training device which entails impacting of the impact member by a hockey stick of a practicing athlete to lift the lower end of the impact member from ground level, thereby simulating an act of sweeping or batting out an opponent's hockey stick during a face-off. One or more springs bias the impact member into the normal position to provide improved resistance. By sweeping or batting away the opponent's stick, the player would gain access to the puck in a real face off situation.

U.S. Pat. No. 6,245,002 (Beliakov) discloses an exercising apparatus for development of muscles in athletes, including hockey players. In a preferred embodiment, the apparatus uses two magnetic members for magnetic retention together with a predetermined magnetic force. The first magnetic member is affixed to a hockey stick to be manipulated by a hockey player. The second magnetic member is positioned at a restrained position from which an athletic stroke is initiated for magnetic retention together with the first magnetic member. The system permits an athlete to develop strength and speed and muscular reaction over an athletic stroke by manual manipulation of the athletic vehicle to overcome the predetermined magnetic force.

U.S. Pat. No. 7,121,964 (Dahm et al.) is directed to a hockey puck face-off method and apparatus. Disclosed is a system for dropping a hockey puck to facilitate or simulate hockey face offs.

Canadian Patent No. 1221593 (Boni) is directed to an apparatus for simulation of ice hockey face offs. It is arranged to drop pucks intermittently, one at a time, from a stack for rapid succession face off simulations.

While the aforementioned devices may be generally suitable for their intended uses, they still leave much to be desired from the standpoint of providing a training device for face offs and similar athletic moves in ice hockey, lacrosse, roller and street hockey, etc., that is lightweight, small enough to fit in a sports bag, easily portable, easy to use, cost effective, and that can be used almost anywhere a player feels like practicing. As such there is a need for such training devices and for methods of use thereof. The subject invention addresses those needs by providing a device and method of use that will develop muscle memory, strengthen the player, build confidence, and improve reaction time in the skill of winning face offs. Moreover, the subject device and method of use enables an athlete or player to work solo and independent to develop his/her face off skills with a portable device that can travel easily with them. Such a device is usable at home, at the rink, outside, before a game as a warm up, etc. Further still, the subject invention and method of use enables the user to focus on strength development, timing reflex, and overall skills development for face offs.

All of the references as cited herein are specifically incorporated by reference.

SUMMARY OF THE INVENTION

One aspect of this invention is a training device for training a person to accomplish a face-off in a sport making use of a stick having a heel. The training device comprises a base connector, a main resilient member and a stick wrap. The base connector is configured for connecting the device to a base in the form of a stationary member. The main resilient member has a distal end portion and a proximal end portion. The proximal end portion is connected to the base connector. The main resilient member is configured to stretch from an unstretched state to a stretched state when a first force is applied to it, and to automatically return to the unstretched state when the first force is released, whereupon it provides resistance to the movement of the stick replicating a face-off motion. The stick wrap is configured to be releasably connected to the distal end portion. The stick wrap includes a first strap portion, a second strap portion, and an intermediate strap portion interconnecting the first and second strap portions. The intermediate strap portion is connected to the distal end of the main resilient member. The first strap portion is configured to be wrapped about and releasably secured to a portion of the stick on a first side of the heel. The second strap portion is configured to be wrapped about and releasably secured to a portion of the stick on a second side of the heel to thereby releasably secure the stick wrap to the heel, whereupon the stick wrap is resistant to accidental displacement from the heel.

In accordance with one preferred aspect of the training device, it additionally comprises an auxiliary resilient member. The auxiliary resilient member is configured to be connected in parallel with the main resilient member, to stretch from a unstretched state to a stretched state when a second force is applied to it, and to automatically return to the unstretched state when the second force is released, whereupon the auxiliary resilient member provides additional resistance to the movement of the stick replicating a face-off motion, with the additional resistance being equal to the sum of the first and second forces.

In accordance with another preferred aspect of the training device, the base connector is in the form of a loop configured to encircle the base.

In accordance with another preferred aspect of the training device, the base connector comprises an elongated base strap having a distal end portion, a proximal end portion, a distal connector, and a proximal connector. The distal end portion of the elongated base strap is connected to the proximal end of the main resilient member. The distal connector is secured to the elongated base strap adjacent the distal end portion of the elongated base strap. The proximal connector is connected to the proximal end portion of the elongated base strap. The distal connector and the proximal connector are releasably securable to each other to form the loop.

In accordance with another preferred aspect of the training device, the distal end portion of the elongated base strap includes a bulge portion, configured to engage a door jamb to releasably secure said base strap to said door jamb.

In accordance with another preferred aspect of this invention, the bulge portion comprises at least one knot of said elongated base strap.

In accordance with another preferred aspect of the training device, the loop is adjustable in size.

In accordance with another preferred aspect of the training device, the main resilient member comprises an elongated strap.

In accordance with another preferred aspect of the training device, the main resilient member comprises an elongated strap and the auxiliary resilient member comprises an elongated strap.

In accordance with another preferred aspect of the training device, the auxiliary resilient member includes a proximal end and a distal end. The auxiliary resilient member is configured to be held in a stowed state on the device with the proximal end of the auxiliary resilient member connected to the base connector. The distal free end of the auxiliary resilient member is configured to be releasably secured to the intermediate strap portion of the stick wrap.

In accordance with another preferred aspect of the training device, the auxiliary resilient member is configured to be extended from the compact state to an extended state wherein the auxiliary resilient member extends parallel to the main resilient member, and wherein the device additionally comprises a cleat connected to the intermediate strap portion of the stick wrap. The distal free end of the auxiliary resilient member is configured to be releasably secured to the cleat when the auxiliary resilient member is in the extended state.

In accordance with another preferred aspect of the training device, the auxiliary resilient member is looped when in the stowed state and is held in the stowed state by releasably securable holder.

Another aspect of this invention is a method of training a person to accomplish a face-off in a sport making use of a stick having a heel and a shaft. The method comprises providing a training device including a base connector, a main resilient member and a stick wrap. The main resilient member has a distal end portion and a proximal end portion. The proximal end portion is connected to the base connector. The main resilient member is configured to stretch from an unstretched state to a stretched state when a first force is applied to it, and to automatically return to the unstretched state when the first force is released, whereupon it provides resistance to the movement of the stick replicating a face-off motion. The stick wrap includes a first strap portion, a second strap portion, and an intermediate strap portion interconnecting the first and second strap portions. The intermediate strap portion is connected to the distal end of the main resilient member. The base connector is utilized to secure the training device to a stationary base. The first strap portion is wrapped about a portion of the stick on a first side of the heel to releasably secure the first strap portion thereto. The second strap portion is wrapped about a portion of the stick on a second side of the heel to thereby releasably secure the stick wrap to the heel, whereupon the stick wrap is resistant to accidental displacement from the heel. The stick is grasped by the person grasping the stick by the handle and moving the stick to replicate a face-off motion to cause the main resilient member to stretch, whereupon the stretching of the main resilient member provides resistance to movement of the stick replicating a face-off motion In accordance with one preferred aspect of the method of this invention, the sport is hockey and the stick is a hockey stick having a blade connected to the shaft by the heel.

In accordance with another preferred aspect of the method of this invention, the method additionally comprises connecting an auxiliary resilient member in parallel to the main resilient member. The auxiliary resilient member is configured to stretch from a unstretched state to a stretched state when a second force is applied to it, and to automatically return to the unstretched state when the second force is released, whereupon the auxiliary resilient member provides additional resistance to the movement of the stick replicating a face-off motion, with the additional resistance being equal to the sum of the first and second forces.

DETAILED DESCRIPTION OF PREFERRED EMBODIMENTS

Figure 1:
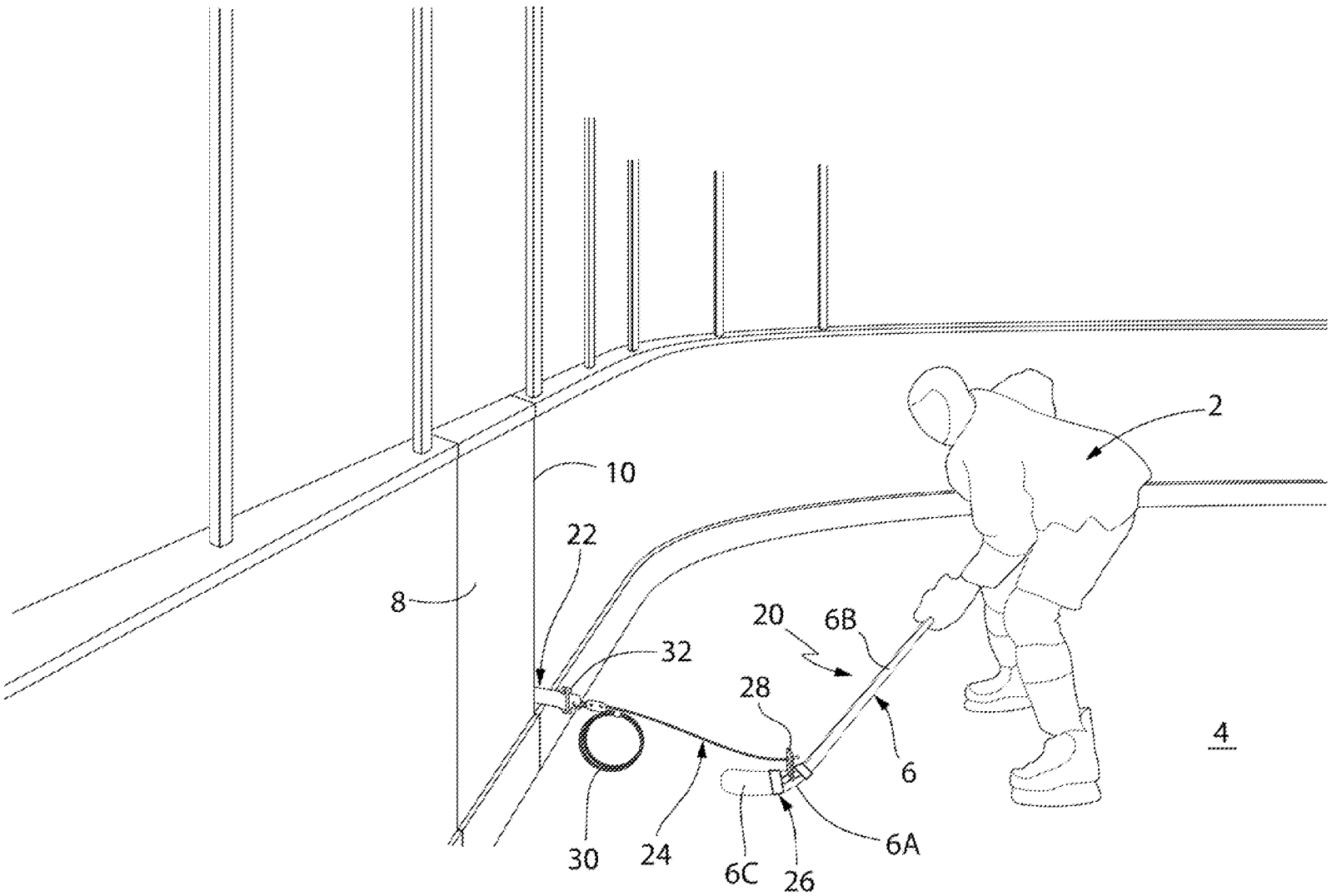
FIG. 1 is an illustration of one exemplary training device constructed in accordance with this invention for training a person for hockey face offs, with the training device being shown in use in a hockey rink, wherein the device is mounted between the door jamb and door to the rink, by the device's base connector and with an auxiliary resistance-providing member of the training device being shown in a stowed state.

Referring now to the various figures of the drawing wherein like reference characters refer to like parts, there is shown in FIG. 1 one exemplary embodiment of a device 20 constructed in accordance with one exemplary preferred embodiment of this invention for training a person to accomplish a face-off in a sport making use of a stick having a heel. The training device basically comprises a base connector 22, a main resilient member 24, and a stick wrap 26.

The details of the construction and operation of those components will be described later. Suffice it to state that the base connector 22 is configured for connecting the training device to a stationary base where the user of the training device will practice face-offs with an athletic stick (e.g., a hockey, lacrosse, or other athletic stick). The main resilient member 24 is configured to stretch from an unstretched state to a stretched state when a first force is applied to it, and to automatically return to the unstretched state when the first force is released, whereupon it provides resistance to the movement of the athletic stick, when the user practices face-offs with the stick being moved to replicate a face-off motion. The stick wrap 26 serves to releasably secure the training device to the athletic stick, e.g., at the heel of the stick, so that it is resistant to accidental displacement therefrom during use of the training device. By so doing, consistency of training using the device is ensured.

Figure 6:
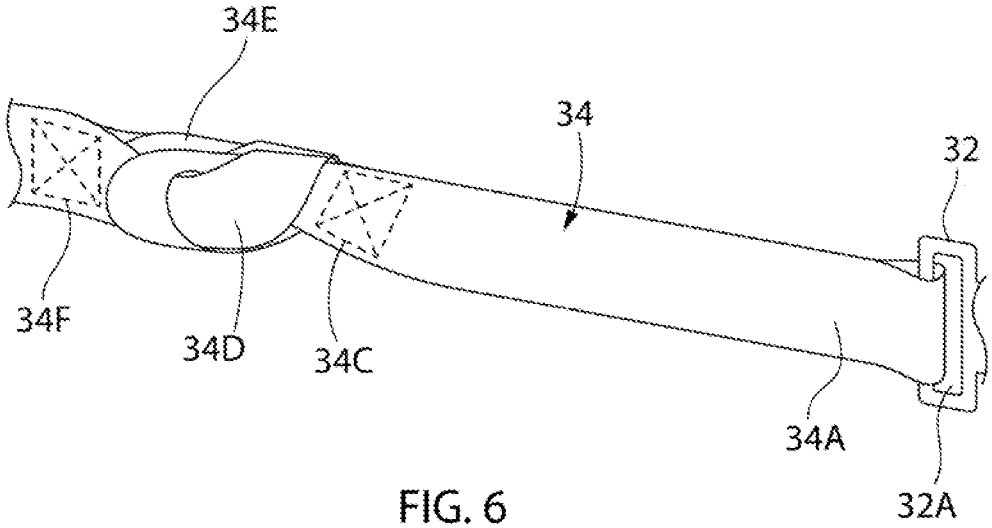
FIG. 6 is an enlarged isometric view of a portion of the training device which is located between a door jamb and door to releasably mount the training device thereto as shown in FIG. 1.

In FIG. 1 the user 2 of the training device 20 is shown in a hockey rink 4 holding a hockey stick 6 to practice face-offs. In that application the base connector 22 of training device is shown releasably mounted between a door 8 and its associated door-jamb 10 of the rink 4. The manner of that releasable mounting will be described later with reference to FIG. 6. The stick wrap 26 is shown releasably secured to the heel 6A of the hockey stick 6. The manner of the releasable securement of the stick wrap on the heel of the hockey stick will be described later with reference to FIG. 4B.

With the training device 20 mounted as shown in FIG. 1, when the user moves the hockey stick by its shaft 6B to replicate a face-off motion, the movement of the blade 6C of the stick will be resisted by the main resilient member 24 as it is stretched.

Figure 2:
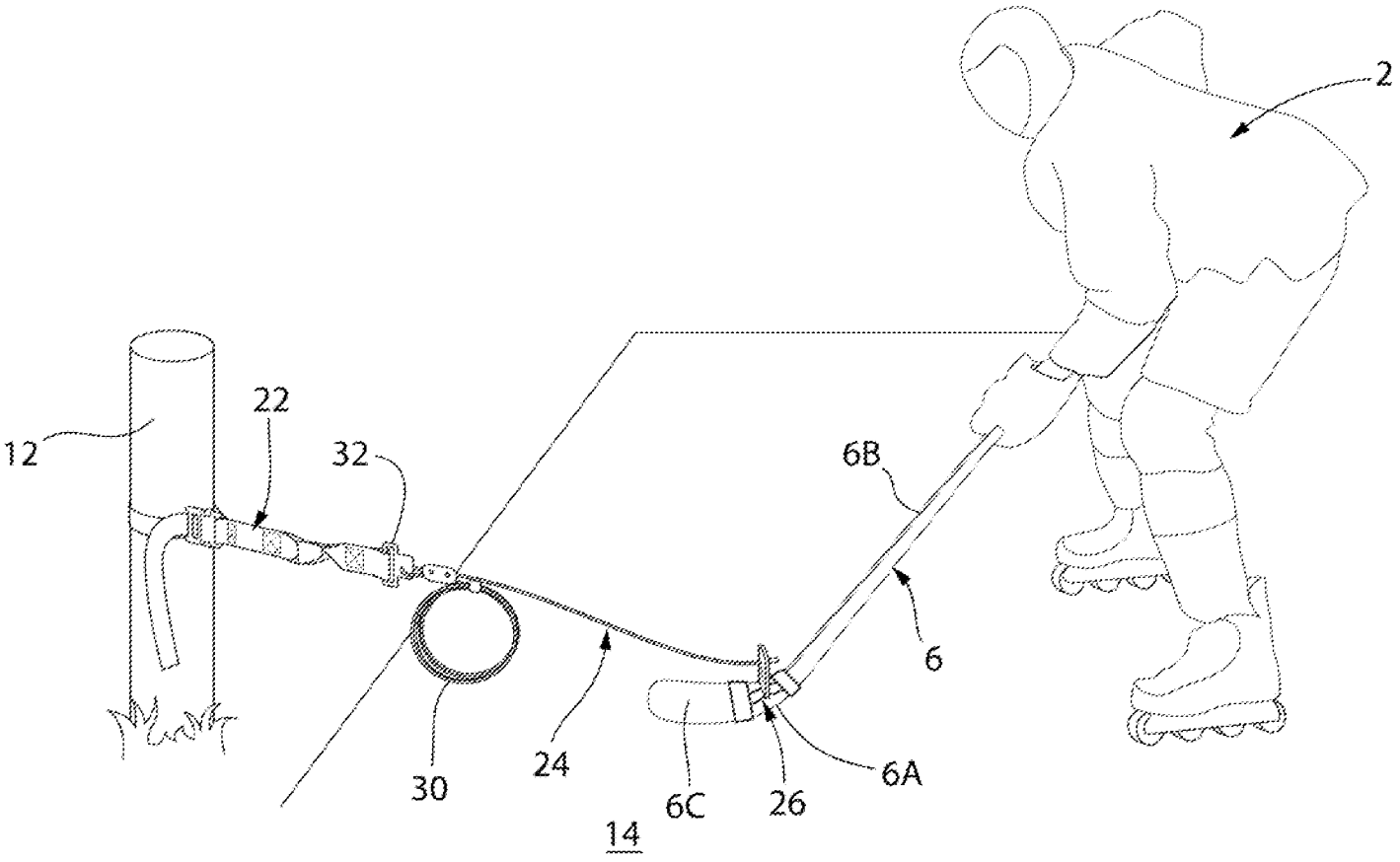
FIG. 2 is an illustration of the exemplary training device shown in FIG. 1, but shown with the training device being mounted on a stationary member, e.g., an upstanding post, adjacent a playground surface.

In FIG. 2 the training device 20 is shown with its base connector 22 releasably secured to on a stationary member, e.g., an upstanding post 12, adjacent a playground surface 14 so that the user 2 can practice face-offs using the hockey stick 6 adjacent the post 12. The manner of releasably mounting the training device 20 to the post 12 will also be described later.

Figure 3A:
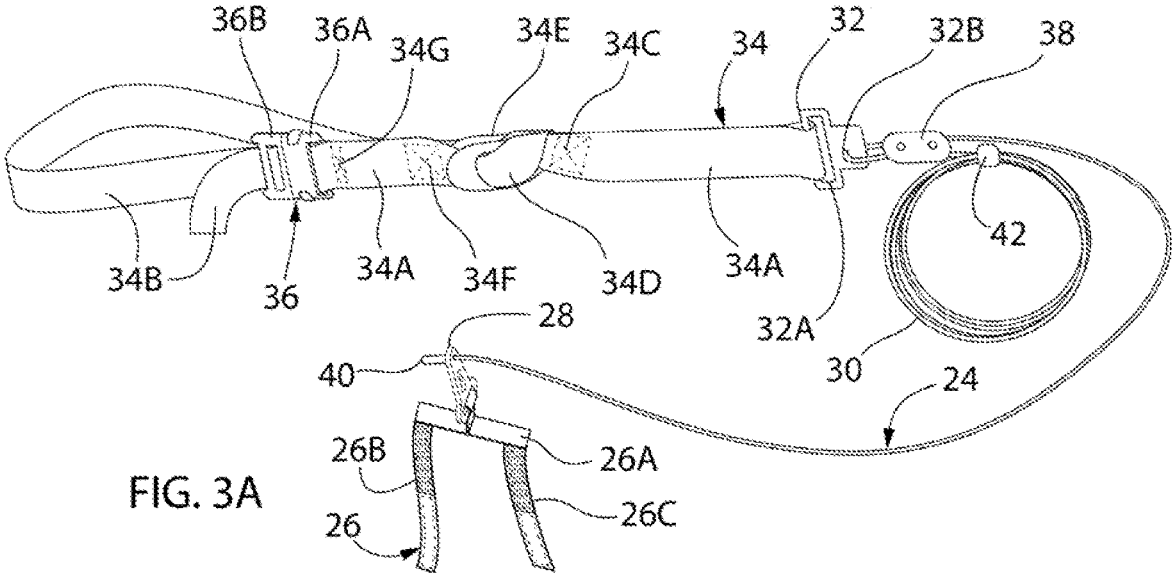
FIG. 3A is an isometric view of the training device shown in FIGS. 1 and 2.
Figure 3B:
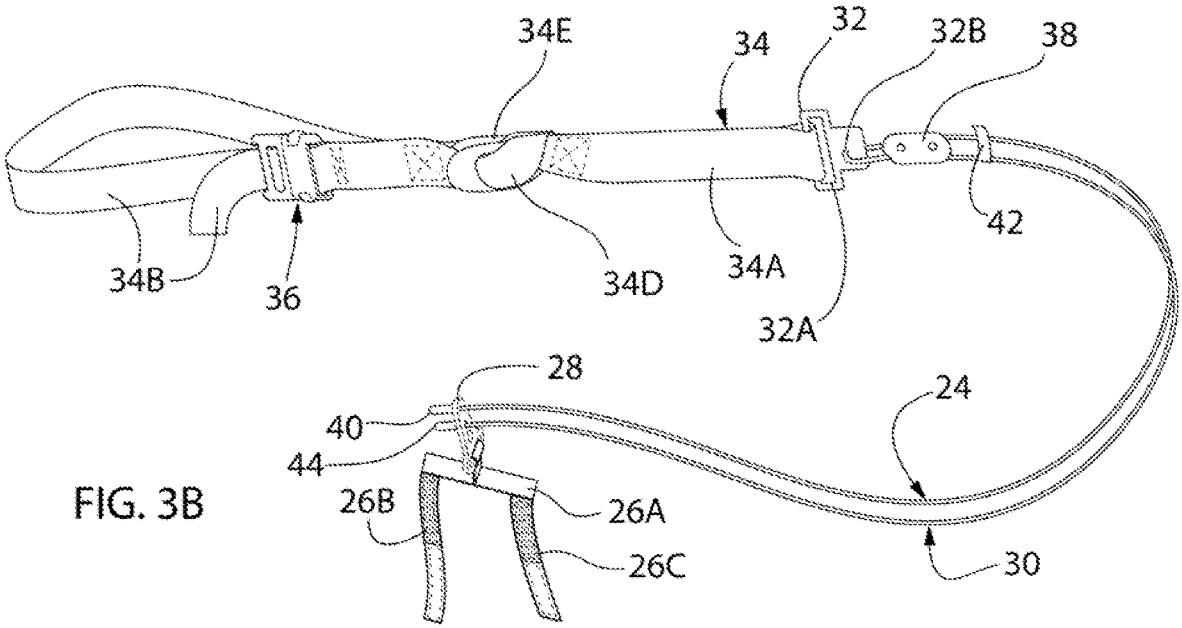
FIG. 3B is an isometric view of the training device shown in FIG. 3A but with its auxiliary resistance providing member (i.e., its auxiliary resilient member), being shown in its extended state wherein it is connected in parallel to the main resistance-providing member (i.e., its main resilient member) of the training device.
Figure 3C:
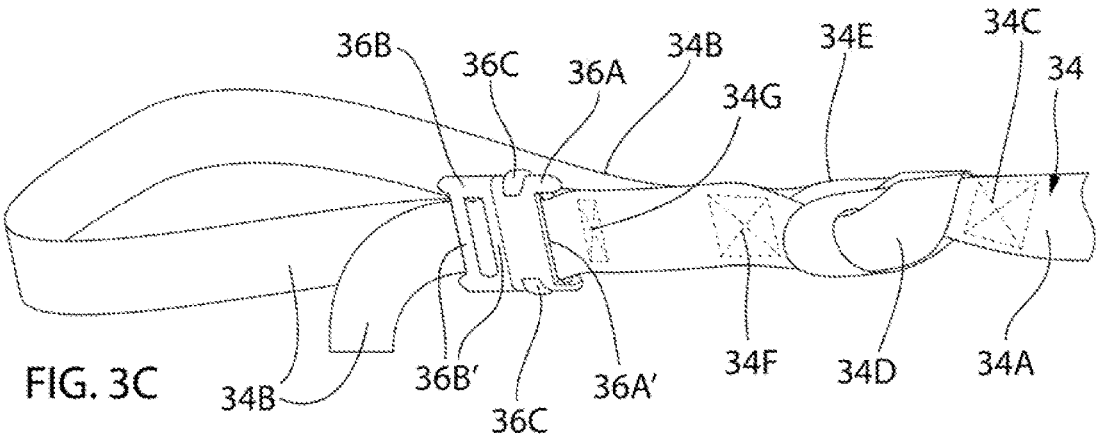
FIG. 3C is an enlarged isometric view of a proximal portion of the training device shown in FIGS. 3A and 3B to show the details of its base connector.

As best seen in FIG. 3A, in addition to the base connector 22, the main resilient member 24, and the stick wrap 26, the training device also includes a distal cleat 28, an auxiliary resistance band or strap 30, and a proximal cleat 32. The details of the construction and operation of those components will be described later, after a description of the base connector.

The base connector 22 is in the form of an adjustable mounting or locking strap to releasably secure the training device to the interface between a door and door jamb, like shown in FIG. 1, or to a stationary member, like the post shown in FIG. 2, or any other stationary member about which the base connector can be looped. The details of the base connector are best seen in FIGS. 3A, 3B, 3C and 6. Thus, as can be seen the base connector and includes an elongated base strap 34 formed of any suitable material, e.g., nylon webbing or any other flexible, but non-stretchable material. The base strap 34 has a distal end portion which is folded over itself to form two parallel strap sections 34A and 34B which are sewed together by lines of stitching 34C to form a loop fixedly securing those sections to the proximal cleat 34 to it. In particular, the folded over portion of the strap sections 34A and 34B form a loop which extends through a slot 32A in the cleat 32. The each parallel section of the base strap 34 includes a knot at approximately the midpoint of its associated parallel strap section and closely adjacent the lines of stitching 34B. In particular, the strap section 34A includes a knot 34D at approximately its midpoint. The strap section 34B includes a knot 34E immediately adjacent the knot 34D. The two knots together form a bulges in the base strap 34 to serve as a stop to engage the adjacent surfaces of the rink door 8 and its door jamb 10 when the base strap is extended between the door jamb 10 and the door 8 like shown in FIG. 1. That action prevents the base connector from being pulled out of the interface between the door and its jamb during use of the training device 20.

The strap section 34A located proximally of the knot 34D extends through a slot 36A' in one connector component 36A of a snap-connector 36 and is doubled back towards the knot 34D so that its end is located adjacent the knot 34D and is secured in place by lines of stitches 34F. The two webs of the doubled back strap section of 34A are secured together by lines of stitching 34G immediately adjacent the slot 36A' of the connector 36A so that the connector 36A cannot slide with respect to the strap section 34A. The foregoing arrangement secures the strap section 34A to the connector 36A.

The strap section 34B which extends proximally of the knot 34E is connected to the mating connector 36B of the snap connector 36. In particular, the free end of the strap section 34B is extended in and out of a pair of slot 36B' in the connector 36B and back over itself to adjustably secure that strap section to the connector 36B. The snap connector 36 is a conventional component like that found in various products, such as back packs, belts, etc., wherein prongs 36C of the connector 36B are arranged to snap into associated slots in the connector 36A, thereby releasably connecting the two connectors 36A and 36B together. Inasmuch as the strap section 34B extends in and out of the slots 36B' the length of the strap section 34B from the knot 34E to the connector 36B can be adjusted. That enables the user to adjust the size of the loop created by the strap section 34B to surround any size stationary point, e.g., the post 12. It should be pointed out that other types of connectors and other arrangements of the strap sections can be used so long as the resulting base connector includes a strap that is adjustable and includes at least one bulge to act as a stop when the base connector is used to releasably secure the training device to the interface of a door and door jamb.

The main resilient member 24 is an elongated elastic component formed of any strong resilient material, e.g., rubber, etc. It can be either in the form of a cord of a single fiber or strand a cable of multiple fibers or strands, or it may be in the form of a flat web or strap and serves to provide resistance to the movement of the stick 6 when the training device is in use and the user is practicing face-off motions with the stick. The main resilient member 24 in the embodiment shown is in the form of an elastic cord whose proximal end is fixedly secured to the proximal cleat 32. That securement is best seen in FIG. 3A and is accomplished by the proximal end of the cord 24 extending through a hole 32B in the cleat 32 and terminating in a connector 38. The proximal end of the auxiliary resilient member 30, whose details will be described shortly, is fixedly secured to the connector 38. In fact the auxiliary resilient member 30 may merely be an extension of the main resilient member 26 extending away from the connector 38.

Figure 4A:
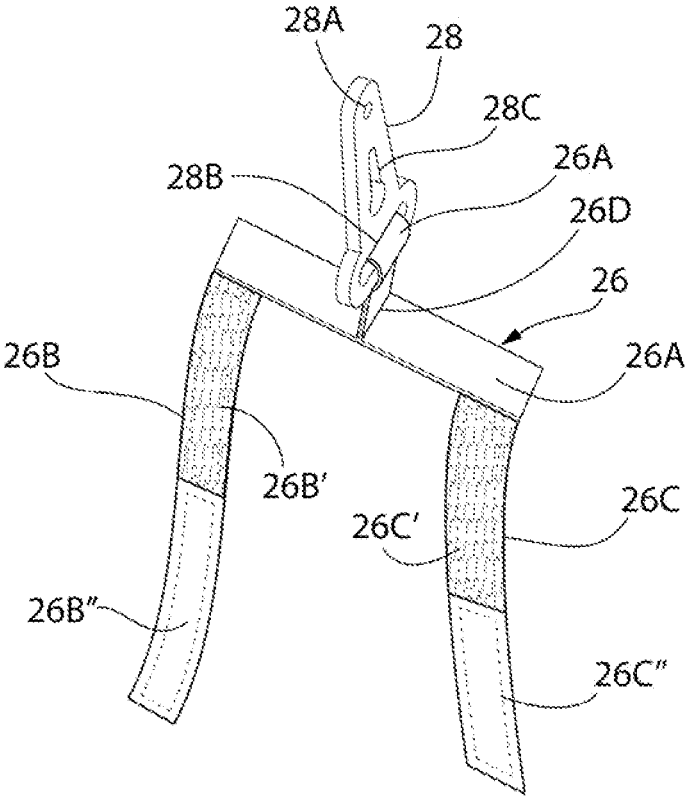
FIG. 4A is an enlarged isometric view of one component, i.e., a stick wrap, of the training device shown in FIGS. 1-3B.
Figure 4B:
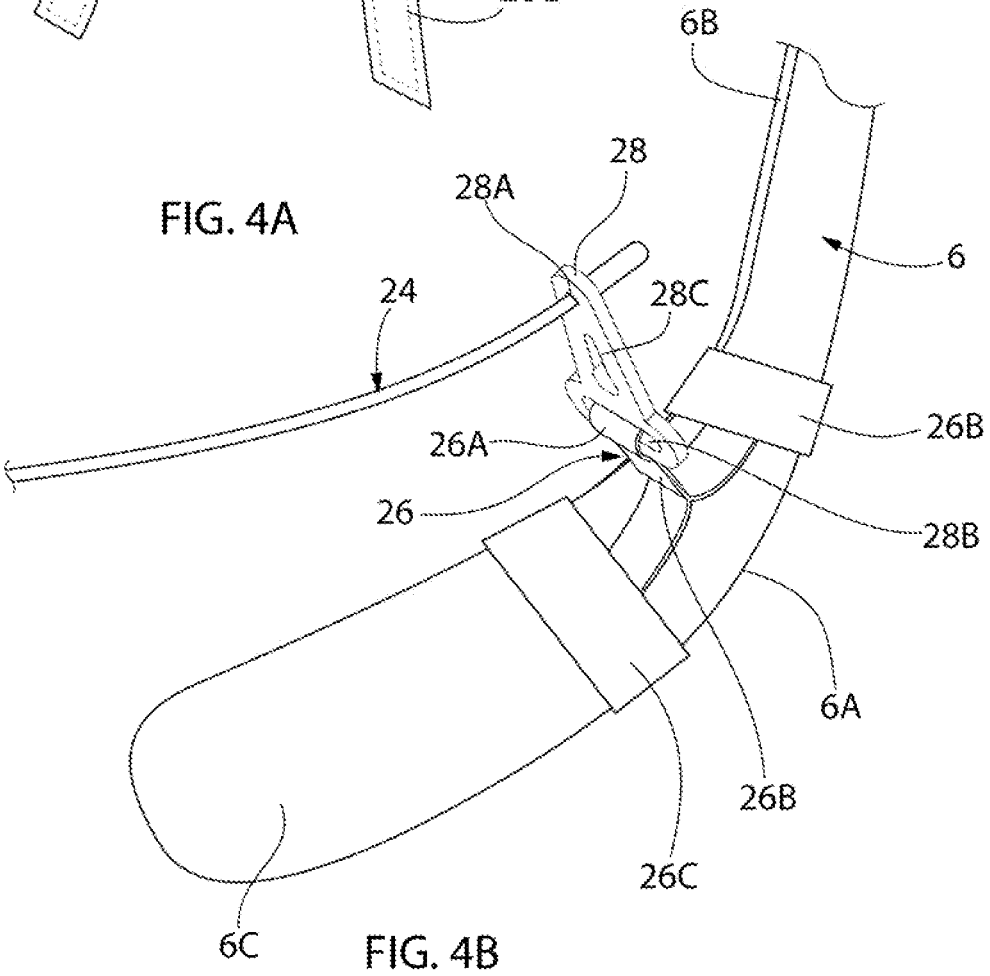
FIG. 4B is an enlarged isometric view of the stick wrap of FIG. 4A shown being releasably secured to the heel of a hockey stick like shown in FIGS. 1 and 2 by means of a cleat.
Figure 5:
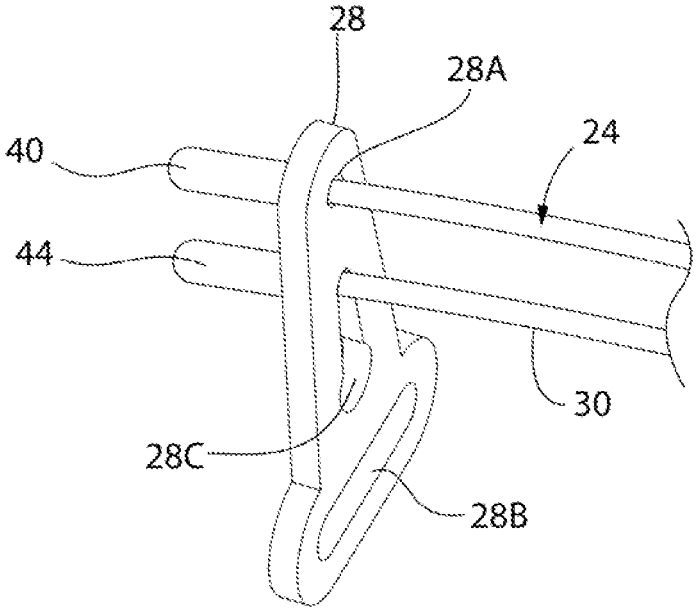
FIG. 5 is an enlarged isometric view of the cleat shown in FIG. 4B with the distal ends of the main resilient member and the auxiliary resilient member being connected to the cleat.

The distal end of the main resilient member 24 extends through a hole 28A (FIGS. 4A, 4B and 5) in the cleat 28 and is held in place by a plug 40 having a larger diameter than that of the main resilient member and located at the distal end thereof. The cleat 28 connects the distal end of the main resilient member to the stick wrap 26. The stick wrap is configured to be releasably secured to the heel 6A of the hockey stick 6 or the heel of any other athletic stick used in face-offs so that the user can practice face offs with the training device. The stick wrap is best seen in FIGS. 4A and 4B and is in the form of an assembly of a strip 26A of strong flexible webbing material, e.g., nylon, webbing and two strips of a releasably securable, e.g., VELCRO® material 26B and 26C. In particular the strip 26A is folded over itself at its midpoint to extend through a slot 28B in the cleat 28. The folded over portions are sewn together by lines of stitches 26D to secure the strip 26 to the cleat 28. One end of the VELCRO® strip 26B is fixedly secured to one end of the strip 26A and a corresponding end of the other VELCRO® strip 26C is fixedly secured to opposite end of the strip 26A. One side of the portion 26B' of the VELCRO® strip 26B that is located immediately adjacent the strip 26A is in the form of a multitude of hooks. The remainder of the strip 26B which forms the free end portion 26B" includes a plush or multi-loop surface on the opposite side of the strip 26B. In a similar manner one side of the portion 26C' of the VELCRO® strip 26C that is located immediately adjacent the strip 26A is in the form of a multitude of hooks. The remainder of the strip 26C which forms the free end portion 26C" includes a plush or multi-loop surface on the opposite side of the strip 26C.

The releasable securement of the stick wrap to the heel of the stick 6 is accomplished by tightly wrapping the end portion 26B" of the strip 26B about the shaft 6B of the stick immediately to the side of the heel 6A, whereupon the multitude of hooks 26B' on the strip portion 26B engage the multitude of loops on the strip portion 26B" to thereby releasably secure the strip 26B to the stick. In a similar manner, the end portion 26C" of the strip 26C is wrapped tightly about the blade 6C of the stick immediately to the side of the heel 6A, whereupon the multitude of hooks 26C' on the strip portion 26C engage the multitude of loops on the strip portion 26C" to thereby releasably secure the strip 26C to the stick. That action completes the securement of the stick wrap to the heel of the stick, with the distal end of the main resilient member thus being connected to the heel of the stick.

It should be noted that in lieu of VELCRO® strips 26B and 26C, other strips including any type of releasably securable fastener (e.g., buttons, press studs (snaps), hook and eyes, etc.), may be used to hold the wrapped portion of the strip in place on the portion of the stick adjacent the stick's heel.

The main resilient member, which may also be referred to as the main resistance member, is configured to stretch from a unstretched state to a stretched state when a first force is applied to it, and to automatically return to the unstretched state when that force is released, whereupon it provides a resistance R(main) to the movement of the stick replicating a face-off motion. The value of R(main) would be appropriate for a wide variety of users of various ages and strengths. Moreover, the training device may be provided in the form of a kit having plural main resilient members, each providing a different level of resistance so that the user can select the desired level of resistance that the training device will provide when the user uses it to practice face-offs.

As should be appreciated by those skilled in the art with the stick wrap being releasably connected as just described the use of the training device 20 will focus resistance at the correct spot of the stick to best train the user for accomplishing face offs. Moreover, once the stick wrap 26 is secured to the heel of the stick as just described it will be resistant to accidental displacement or movement away from the heel of the stick until the stick wrap is intentionally disconnected by the use and removed from the stick by the user. That feature provides consistent repeatability of resistance training by the user of the device in practicing face-offs since the same amount of resistance will always be applied at the same location on the stick.

The auxiliary resilient member 30, which may also be referred to as the auxiliary resistance member, is an elongated elastic member constructed like the main resilient member and is provided to allow the user to add the additional resistance R(aux) to the training device 20 in addition to the resistance R(main) provided by the main resilient member 24. Thus, the auxiliary resilient member 30 is configured to stretch from an unstretched state to a stretched state when a second force is applied to it, and to automatically return to the unstretched state when that force is released, whereupon it provides resistance R(aux) to the movement of the stick replicating a face-off motion.

The auxiliary resilient member 30 is arranged to be connected in parallel to the main resilient member, as will be described shortly. The auxiliary resilient member 30 can be configured to provide the same level of resistance as the main resilient member 24, in which case when connected in parallel with the main resilient member 30, results in the training device providing resistance equal to the sum of the resistances R(main) plus and R(aux) provided by the both members 24 and 30, i.e., double the resistance that is provided when only the main resilient member is used alone. If the auxiliary resilient member provides a different resistance than the main resilient member the composite resistance provided by the parallel combination of the two resilient members 24 and 30 will not be double R(main) but will be R(main) plus R(aux).

It should be pointed out at this juncture that the subject invention contemplates the use of multiple auxiliary resistance members that could be connected in parallel to the main resistance member. Moreover, as mentioned above the training device of the subject invention may be provided as a kit. That kit may also include multiple auxiliary resistance members, each being of a different R(aux) resistance, and which could be used either singly or in multiples in parallel with the main resilient member to provide the desired amount of resistance.

The auxiliary resilient member 30 is normally held in a rolled-up stowed state, like shown in FIGS. 1, 2 and 3A, and is arranged to be unrolled from its stowed state to an extended state where it extends in parallel to the main resilient member. The auxiliary resilient member is of the same length as the main resilient member so that when they are connected in parallel both will be in their unstretched state until a force is provided to stretch them. The auxiliary resilient member is held in its rolled-up stowed state by use of any type of clip 42, e.g., a strip of double sided VELCRO® tape. When it is desired to use the auxiliary resilient member to provide additional resistance to the training device 20, the clip is released and the rolled-up auxiliary resilient member un-rolled. The distal end of the auxiliary resilient member 30 is in the form of an enlarged plug 44. The cleat 28 includes a keyway shaped slot 28C having an enlarged lower end through which the auxiliary resilient member 30 with its enlarged plug 44 is extended. Once the enlarged plug is extended through the enlarged lower end of the keyway slot, the auxiliary resilient member contiguous with the plug 44 is slid into the narrower keyway of the slot 26C to releasably secure the distal end of the auxiliary resilient member to the cleat 28. Once so connected the training device 20 can be used to provide increase resistance to the motion of the stick replicating a face-off. If it is desired to no longer use the auxiliary resilient member with the training device, all that is required is to slide the distal end of the auxiliary resilient member down the keyway of the slot 28C until it reaches the enlarged lower end of the slot, at which time the enlarged plug 44 can pass through the enlarged lower end of the slot. That action frees the distal end of the auxiliary resilient member so that it can be rolled up to the stowed state shown in FIGS. 1, 2, 3A and 3B.

It should be pointed out that the exemplary embodiment as shown and described above is merely one of the various constructions that the training device of this invention may take within the scope of this invention. What is important is that the training device includes some means to releasably secure its proximal end portion to some stationary structure to mount the device for use. In addition, the training device should provide a connector for connecting the distal end of the device to the heel or some other desirable portion of a stick used in some sport involving face-offs so that it is resistant to accidental displacement therefrom and a resilient member configured to provide a desired level of resistance between the distal and proximal end portions of the training device when the device is used with a stick replicating a face-off motion.

Without further elaboration the foregoing will so fully illustrate my invention that others may, by applying current or future knowledge, adopt the same for use under various conditions of service.

I claim:

1. A training device for training a person to accomplish a battle for a puck or a ball in a sport making use of a stick having a heel, said training device comprising:

a base connector for connecting said device to a base in a form of a stationary member;

a main resilient member having a distal end portion and a proximal end portion, said proximal end portion being connected to said base connector, said main resilient member being configured to stretch from a unstretched state to a stretched state when a first force is applied to it, and to automatically return to said unstretched state when the first force is released, whereupon it provides resistance to a movement of the stick replicating a face-off motion; and a stick wrap configured to be releasably connected to said distal end portion, said stick wrap including a first wrapping portion, a second wrapping portion, and a third portion, said third portion interconnecting said first and second wrapping portions and holding said first wrapping portion spaced apart from said second wrapping portion, said third portion being connected to said distal end of said main resilient member between said first wrapping portion and said second wrapping portion, said first wrapping portion being configured to be wrapped about and brought into engagement with a first portion of the stick on a first side of the heel, said second wrapping portion being configured to be wrapped about and brought into engagement with a second portion of the stick on a second side of the heel, the second side of the heel being opposite the first side of the heel, whereupon said stick wrap is wrapped about the stick to have said first wrapping portion wrapped about said first portion of the stick and said second wrapping portion wrapped about said second portion of the stick to thereby releasably secure said stick wrap to the heel, whereupon said stick wrap is resistant to accidental displacement from the heel.

2. The training device of claim 1, additionally comprising an auxiliary resilient member configured to be connected in parallel with said main resilient member, said auxiliary resilient member being configured to stretch from a unstretched state to a stretched state when a second force is applied to it, and to automatically return to the unstretched state when the second force is released, whereupon said auxiliary resilient member provides additional resistance to the movement of the stick replicating a face-off motion, with the additional resistance being equal to the sum of the first and second forces.

3. The training device of claim 1, wherein said base connector is in a form of a loop configured to encircle the base.

4. The training device of claim 3, wherein said base connector comprises an elongated base strap having a distal end portion, a proximal end portion, a distal connector, and a proximal connector, said distal end portion of said elongated base strap being connected to said proximal end of said main resilient member, said distal connector being secured to said elongated base strap adjacent said distal end portion of said elongated base strap, said proximal connector being connected to said proximal end portion of said elongated base strap, said distal connector and said proximal connector being releasably securable to each other to form said loop.

5. The training device of claim 4, wherein the distal end portion of the elongated base strap includes a stop configured to engage a door jamb to releasably secure said base strap to said door jamb.

6. The training device of claim 5, wherein the stop comprises at least one knot of said elongated base strap.

7. The training device of claim 4, wherein said loop is adjustable in size.

8. The training device of claim 1, wherein said main resilient member comprises an elongated strap.

9. The training device of claim 2, wherein said main resilient member comprises an elongated strap and said auxiliary resilient member comprises an elongated strap.

10. The device of claim 9, wherein said auxiliary resilient member includes a proximal end and a distal free end, said auxiliary resilient member being configured to be held in a stowed state on said device with said proximal end of said auxiliary resilient member connected to said base connector, said distal free end of said auxiliary resilient member being configured to be releasably coupled to said third strap portion of said stick wrap.

11. The training device of claim 10, wherein said auxiliary resilient member is configured to be extended from said stowed state to an extended state wherein said auxiliary resilient member extends parallel to said main resilient member, and wherein said device additionally comprises a cleat connected to said third strap portion of said stick wrap, said distal free end of said auxiliary resilient member being configured to be releasably secured to said cleat when said auxiliary resilient member is in said extended state.

12. The training device of claim 11, wherein said auxiliary resilient member is looped when in said stowed state and is held in said stowed state by releasably securable holder.

* * * * *